United States Patent [19]

Dantlgraber et al.

[11] Patent Number: 4,538,965

[45] Date of Patent: Sep. 3, 1985

[54] HYDROSTATIC RADIAL PISTON PUMP

[75] Inventors: Jörg Dantlgraber, Lohr-Sackenback; Klaus Morio, Marktheidenfeld, both of Fed. Rep. of Germany

[73] Assignee: Mannesmann Rexroth GmbH, Lohr, Fed. Rep. of Germany

[21] Appl. No.: 655,879

[22] Filed: Sep. 28, 1984

Related U.S. Application Data

[63] Continuation-in-part of Ser. No. 325,843, Nov. 30, 1981, abandoned.

[30] Foreign Application Priority Data

Dec. 12, 1980 [DE] Fed. Rep. of Germany ..... 3046753

[51] Int. Cl.[3] ..... F04B 1/04; F01B 31/10

[52] U.S. Cl. ..... 417/273; 92/157

[58] Field of Search ..... 417/273; 91/488; 92/157

[56] References Cited

U.S. PATENT DOCUMENTS

| | | | |
|---|---|---|---|
| 2,347,663 | 5/1944 | Carnahan | 417/273 |
| 2,679,210 | 5/1954 | Mullor | 91/488 |
| 3,188,973 | 6/1965 | Firth et al. | 91/488 |
| 3,628,425 | 12/1971 | Morita | 91/488 |

FOREIGN PATENT DOCUMENTS

| | | | |
|---|---|---|---|
| 2622010 | 11/1977 | Fed. Rep. of Germany | 417/273 |
| 1228950 | 12/1967 | United Kingdom | 91/488 |

*Primary Examiner*—William L. Freeh

*Attorney, Agent, or Firm*—Michael J. Striker

[57] ABSTRACT

A hydrostatic radial piston pump has a housing with a suction chamber, an eccentric, a pressure valve member spaced from the eccentric and having a convex support, and a movable structural unit arranged between the eccentric and the pressure valve member and including a cylinder with a supporting face and a sealing edge spring-biased against the support of the pressure valve member, and a piston with a piston shoe spring-biased against the eccentric, wherein the supporting face has a circumferential groove subdividing it into an outer and inner annular face portion, the outer annular face portion has at least one substantially radial groove communicating the annular groove with the suction chamber, and the ratio of the force of a biasing spring and the dimension of the supporting face does not exceed substantially 2.5 kp/cm$^2$.

3 Claims, 5 Drawing Figures

HYDROSTATIC RADIAL PISTON PUMP

REFERENCE TO A RELATED APPLICATION

This application is a continuation-in-part of application Ser. No. 325,843 filed Nov. 30, 1981 now abandoned.

BACKGROUND OF THE INVENTION

The present invention generally relates to a hydrostatic radial piston pump.

Hydrostatic radial piston pumps are known in the art. One of such piston pumps is disclosed, for example, in the German Auslegeschrift 2,716,888. It has an eccentric, a pressure valve member with a convex support, and a movable structural unit arranged between the eccentric and the pressure valve member and having a cylinder with supporting face and a sealing edge spring-biased against the support of the pressure valve member, and a piston with a piston shoe spring-biased against the eccentric. In the above described radial piston pump, the supporting face with the sealing edge of the cylinder abutting against the support of the pressure valve member is so dimensioned that the pressure force of a pressure spring providing the above mentioned spring-biasing action is transmitted from the supporting face to the support in a wear-free manner. It is necessary to take into consideration that the lifting force which takes place during the pressure stroke resulting from the hydrostatic pressure acting between the support and the supporting face is smaller than the pressure force acting outwardly for a reliable sealing of this cylinder space. In addition to the spring force, a hydrostatic force acts also as a pressing force in direction from the support of the pressure valve member to the cylinder. The hydrostatic pressing force results from the respective dimensioning of the inner diameter of the sealing edge of the cylinder. The smaller this diameter is selected relative to the piston diameter, the greater is the hydrostatic pressing force acting in direction of the support. The greater, however, is the weight of the supporting face of the cylinder on the support of the pressure valve member, the greater is the danger of a dry friction during the suction stroke of the pump, particularly when low viscosity fluids are utilized for the pump.

SUMMARY OF THE INVENTION

Accordingly, it is an object of the present invention to provide a hydrostatic radial piston pump which avoids the disadvantages of the prior art.

More particularly, it is an object of the present invention to provide a hydrostatic radial piston pump in which the supporting face with sealing edge of the cylinder is retained of a small direction so as to obtain a small lifting force and moreover to guarantee a wear-free operation between the supporting face and support of the cylinder and the pressure valve member.

In keeping with these objects, and with others which will become apparent hereinafter, one feature of the present invention resides, briefly stated, in hydrostatic radial piston pump having a housing defining a suction chamber, an eccentric, a pressure valve member spaced from the eccentric and having a convex support, a movable structural unit arranged between the eccentric and the pressure valve member, the unit including a cylinder having a supporting face with a sealing edge spring-biased against the support of the pressure valve member, and a piston with a piston shoe spring-biased against the eccentric, the supporting face having an inner annular face portion, an additional outer annular face portion increasing the supporting face, and a circumferential groove formed between the face portions, the outer annular face portion of the supporting face also having at least one substantially radial groove communicating the circumferential groove with the suction chamber and performing only supporting function without performing sealing function as well as being lubricated through the grooves, and a pressure spring arranged to bias the supporting face with a sealing edge of the cylinder against the support of the pressure valve member and to bias the piston shoe of the piston against the eccentric in force-transmitting manner, the spring having a predetermined force acting between the annular face portions of the supporting face upon the support of the pressure valve member, the annular face portions of the supporting face having a predetermined dimension increased by the provision of the additional outer annular face portion and selected so that a ratio of the force and the dimension does not exceed substantially 2.5 kp/cm$^2$.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 2:
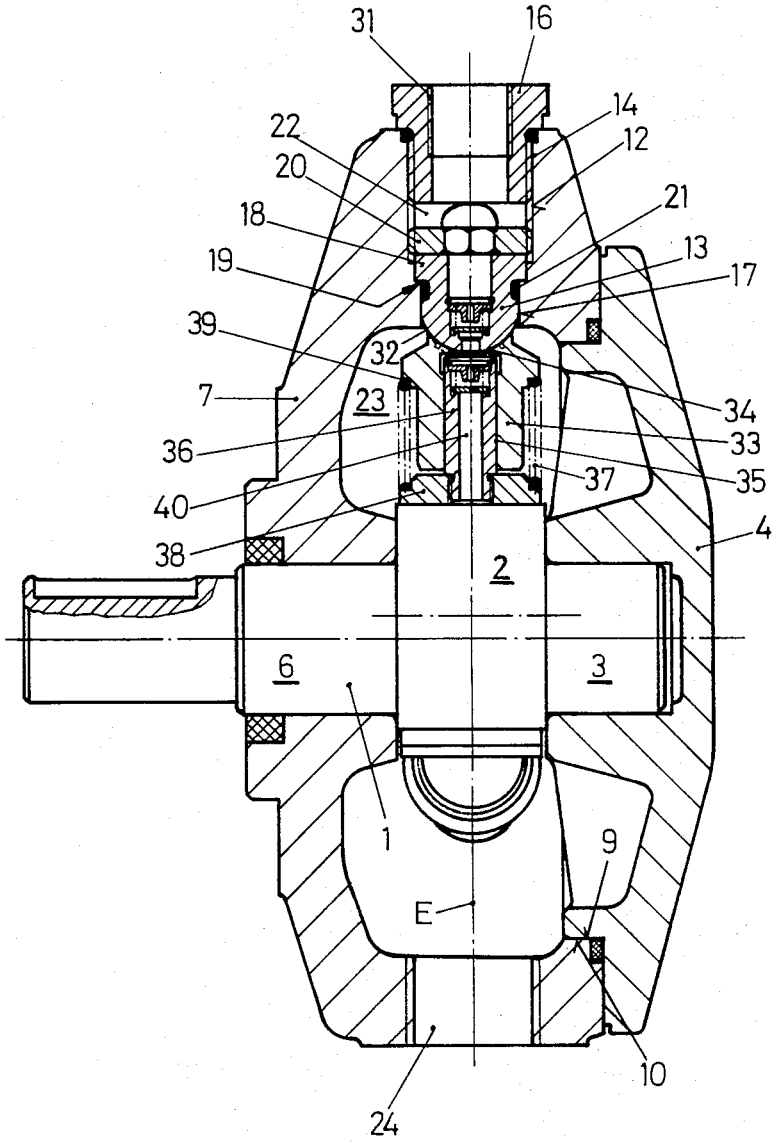
FIG. 2 is a view showing an axial section taken along the line 2—2 in FIG. 1.

A hydrostatic radial piston pump in accordance with the invention has a pump shaft identified by reference numeral 1 and an eccentric 2. The pump shaft 1, as can be seen from FIG. 2, is supported at its two ends and extends outwardly from the housing. One end 3 is supported in a housing cover 4, whereas the other end 6*a* is supported in a pump housing 7.

The pump housing 7 and the housing cover 4 are castings, and the housing cover 4 has an annular bearing face 9 which is received in a respective recess 10 of the pump housing 7. The housing cover 4 is mounted on the pump housing 7 with the aid of screws. Three uniformly distributed radial openings 12 are provided in the periphery of the pump housing and serve for receiving pressure valve members 13. Each radial opening 12 has an outer region 14 provided with a thread for receiving a locking screw 15 or a sleeve member 16 forming a radially outwardly leading pressure port. Each radial opening also has an inner region 17 having a smaller diameter than the outer region 14 and formed as a bearing face for receiving a pressure valve member 13. The pressure valve member 13 has an annular flange 18 which is supported on an annular shoulder 19 of the radial opening and fixed in radial direction by a hollow screw 20. A sealing ring 21 guarantees a tight closure between a pressure chamber 22 and a housing chamber 24 forming a suction chamber having a radially outwardly leading suction port 24.

Figure 3:
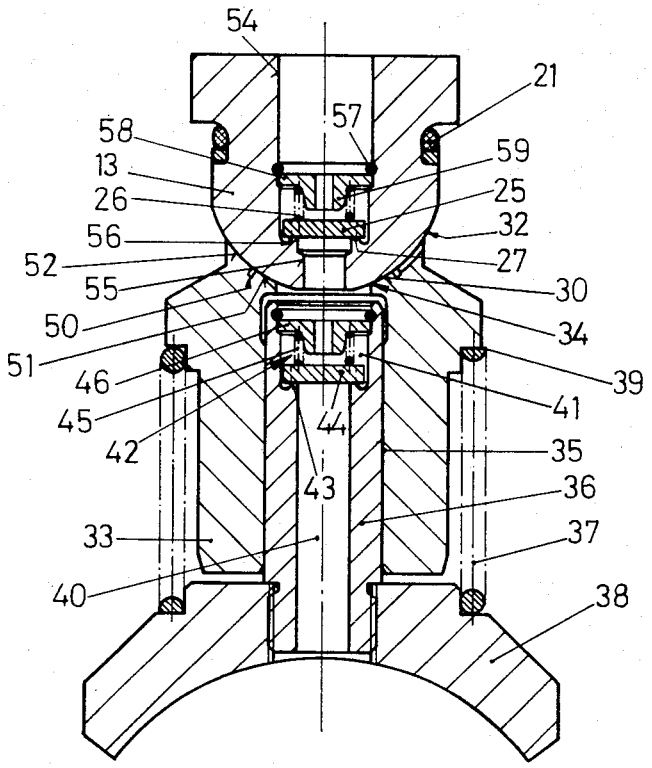
FIG. 3 is an enlarged view showing the pump elements of FIG. 2 with a pressure valve member.

The pressure valve member 13 has a stepped through opening including opening portions 54 and 55 as shown in FIG. 3. A shoulder 27 produced thereby has in the region of the greater opening portion 54 an annular groove 56, so that the shoulder 27 forms a neck-shaped projection and forms a valve seat for a valve body 25. The valve body 25 is plate-shaped and pressed against the valve seat by a pressure spring 26 with a low force. The pressure spring abuts with its other end against a star-shaped spring disk 58. A central part 59 of the spring disk is hub-like and serves simultaneously as a supporting face for the valve member 25 in its open position. The spring disk 58 abuts against the pressure valve member 13 via a spring ring 57.

Figure 1:
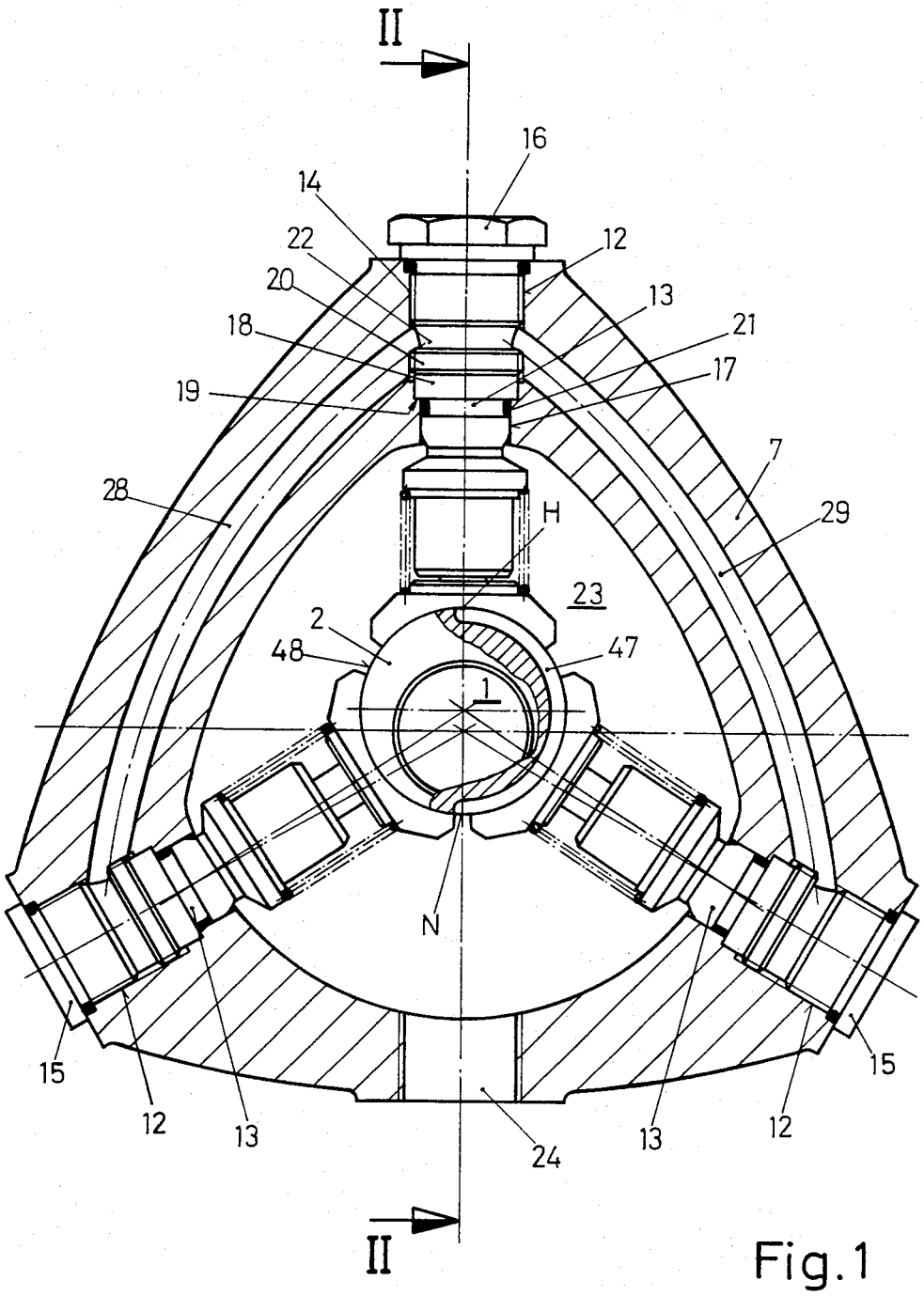
FIG. 1 is a view showing a section taken transverse to an axis of a hydrostatic radial piston pump in accordance with the present invention in the region of pump elements.

The pressure chambers 22 formed between the pressure valve member 13 and the locking screw 15 or the sleeve member 16 communicates with one another via cast passages 28 and 29 which lie in the region of a plane E of the pressure valve member and also between the hollow screw 20 and the locking screw 15 or sleeve member 16, as can be seen in FIG. 1. The sleeve member 16 has an inner thread 31 for connecting of a not shown pressure conduit.

A side 32 of the pressure valve member, facing toward the housing chamber, is formed as a spherical portion. A cylinder 33 with a supporting face 30 having a sealing edge 34 sealingly abuts against this spherical portion. The diameter of the annular sealing edge 34 is smaller than the diameter of a cylinder opening forming a cylinder chamber 35 for a piston 36, and smaller than the part 17 of the opening 12 for receiving the pressure valve member 13. Because of this it is guaranteed that the sealing edge 34 during the working or pressure stroke of the piston 36 sealingly abuts against the spherical portion 32, and the pressure valve member is pressed by a pump pressure from the pressure chamber 22 with its annular flange 18 against the annular shoulder 19 of the stepped radial opening and is thereby fixed in its position.

In addition, the cylinder 33 is pressed by the force of a pressure spring 37 with its sealing edge 34 against the spherical portion 32 of the pressure valve member 13, and thereby also during the suction stroke of the piston 36 the sealing edge 34 of the cylinder 33 sealingly abuts against the spherical portion 32 of the pressure valve member 13.

The pressure spring 37 abuts with its one end against a piston shoe 38 connected with the piston 36 and with its other end against a projecting surface 39 of the cylinder 33.

Figure 4:
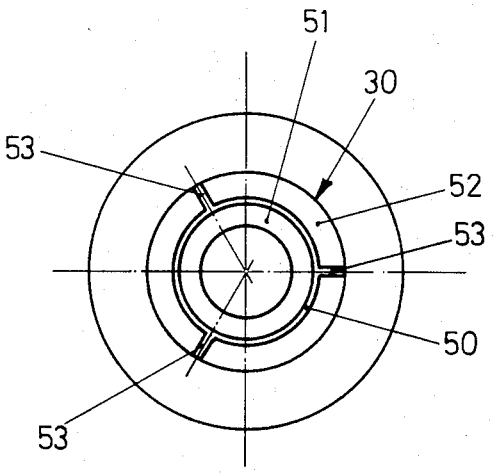
FIG. 4 is a plan view of a supporting face of a cylinder of the hydrostatic radial piston pump in accordance with the present invention.

The supporting face 30 which has the sealing edge 34, has substantially in its central region a circumferential groove 50, as can be seen in FIG. 4. This groove subdivides the supporting face into an inner annular face portion 51 and an outer annular face portion 52. Radially extending grooves 53 are provided in the outer annular supporting face portion 52 and communicate the annular groove 50 with the suction chamber 23 or the pump. It is thereby guaranteed that the outer annular face portion 52 is exclusively under the pressure acting in the suction chamber. A lifting force cannot thereby take place between the outer annular face portion 52 of the cylinder 33 and the convex support 32 of the pressure valve member 13. It is limited only to the inner annular face portion 51 and thereby can be retained in narrow limits.

The annular groove 50 is so arranged that both annular face portions have approximately identical dimensions, and the entire supporting face relative to a maximum spring force pressing the annular face portions against the support of the pressure valve member does not exceed a value of 2.5 kg/cm$^2$. It is thereby guaranteed that, in the event of supply of low viscosity fluids, no friction force affecting the operational safety takes place, and because of the radially extending grooves 53 on the outer annular face portion 52 a good lubrication of the latter is guaranteed.

The pressure spring 37 which presses the cylinder 33 against the pressure valve member 13 in a tight manner must be dimensioned so strongly as not only to provide the tightness between the cylinder and the pressure valve member during the suction stroke, but also it must guarantee that the piston shoe 38 during the suction stroke slidingly abuts against the eccentric 2 and is not lifted from the eccentric because of inertia forces and friction forces between the piston and the cylinder. This means that the pressure spring 37 must not exceed a predetermined pressure force. Because of this minimum pressure force of the pressure spring 37, in the known pumps a sealing force acts on the sealing surface between the cylinder 33 and pressure valve member 13 is produced which lies considerably above the value of 2.5 kg/cm$^2$. By the increase of the supporting surface 30 of the cylinder 33, the sealing surface region formed by the inner annular face portion 51 remains untouched relative to the prior art. The additional outer annular face portion 52, by which the entire pressing surface is increased, does not have any sealing functions, so that it can be formed with respective lubricating grooves 51, 53 so as to prevent a dry running with the counterface on the pressure valve member 13.

The novel features of the present invention are not only limited to the increase of the supporting face 30 so as to attain a surface loading of at most 2.5 kp/cm$^2$, but they also include the fact that the supporting face 30 is subdivided into the face portion 51 and the face portion 52 which later serves only as a supporting surface and is sufficiently lubricated via grooves 50, 53 so as to prevent dry running. Thus, the present invention proposes such a hydrostatic radial piston pump which has both the novel dimensioning of the supporting or sealing surface, and also a novel design of this surface.

Figure 5:
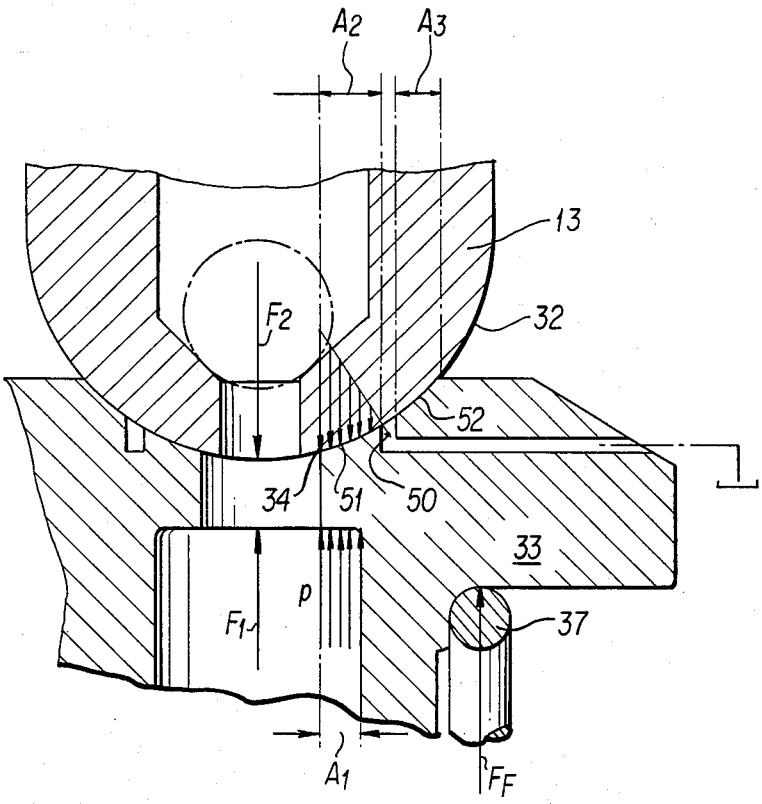
FIG. 5 is a view schematically showing distribution of forces on the supporting face of the cylinder of the inventive radial piston pump.

FIG. 5 schematically shows force distribution on the supporting face 30 of the cylinder 33.

The forces which are applied to the cylinder 33 are:

$$F_1 = p \cdot A_1$$

$$F_2 = \epsilon p \cdot dA_2$$

$$F_f = \text{spring force.}$$

The force which is mechanically applied from the cylinder 33 onto the pressure valve member 13 is:

$$\Delta F = F_1 + F_f - F_2.$$

The surface pressure between the cylinder 33 and the pressure valve member 13 is:

$$\bar{p} = \frac{\Delta F}{A_2 + A_3} = \leqq 2.5 \text{ kp/cm}^2.$$

$A_1$, $A_2$, $A_3$ are respective circular faces.

The pump pressure p acts on the entire circular surface $A_1$. As a result, a force $F_1$ is produced with which the cylinder 33 presses against the surface of the spherical portion 32 of the pressure valve member 13, depending upon the pump pressure. A force $F_f$ of the spring is added to the force $F_1$. A force $F_2$ acts on the cylinder 33 in the opposite direction. This force is produced from the pressure which acts upon the inner annular face portion 51. The pressure at the sealing edge 34 is equal to the pump pressure p. This pressure gradually decreases in the radial direction over the inner annular face portion 51 until it reaches the tank pressure in the annular groove 50. Thereby the force $F_2$ is produced from the sum of products of the respective pressure and the respective partial sealing faces. The remaining differential force from $F_1+F_f-F_2$ acts mechanically as a surface pressure p between the pressure valve member 13 and the cylinder 33. The surface pressure $\bar{p}$ is retained small by the additional outer annular face portion 52 which does not have any sealing functions. Because of different pressure decreases depending on the geometrical ratio at the inner annular face portion 51 of the parts 13,33, the force $F_2$ has a wide dispersion region. By this dispersion a similar dispersion of the differential force is forcedly produced. For maintaining the dispersion of the differential force small, the supporting face is subdivided into the face portions 51 and 52 by the annular unloading groove 50 so that the dispersion of the differential force remains limited to the annular face portion 51. The value of the surface pressure of 2.5 kp/cm$^2$ must not be exceeded. This value is not substantially influenced by different pump pressures which take place. This is provided by that the force $F_2$ must be substantially approximately equal to the force $F_1$. This condition can be attained by the respective dimensioning of $A_1$ and $A_2$. In the event of linear pressure drop at the inner annular face portion 51 this condition is satisfied when $A_2$ is substantially twice as great as $A_1$.

The piston 36 is provided with an axial opening 40 which has at an upper end 41 facing toward the pressure valve member 13 a greater diameter. In this region, elements forming a suction valve 42 are provided, namely a valve seat 43, a plate-shaped closure member 44, a pressure spring 45, and a spring support ring 46 arranged in force-transmitting connection with the piston. The axial opening 40 which forms a piston chamber extends simultaneously through the piston shoe 38 and operatively communicates with a suction groove 47 in a running face 48 of the eccentric 2. The suction groove 47 extends from a highest reverse point H to a lowest reverse point N of the eccentric 2. Thereby, only during the suction stroke of the piston, the running surface of the eccentric is reduced by the suction groove 47 forming connection over the upper surface region from the housing chamber 23 forming the suction chamber and the opening 40 forming the piston chamber. During the subsequent working or pressure stroke of the piston, the entire cross section of the running face 48 of the eccentric is available for transmission of the operating force to the piston 36 via its piston shoe 38.

It will be understood that each of the elements described above, or two or more together, may also find a useful application in other types of constructions differing from the type described above.

While the invention has been illustrated and described as embodied in a hydrostatic pressure piston pump, it is not intended to be limited to the detaileds shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly consitute essential characteristics of the generic or specific aspects of this invention.

What is claimed as new and desired to be protected by Letters Patent is set forth in the appended claims.

We claim:

1. A hydrostatic radial piston pump, comprising a housing defining a suction chamber; an eccentric; a pressure valve member spaced from said eccentric and having a convex support; a movable structural unit arranged between said eccentric and said pressure valve member, said unit including a cylinder having a supporting face with a sealing edge spring-biased against said support of said pressure valve member, and a piston with a piston shoe spring-biased against said eccentric, said supporting face having an inner annular face portion, an additional outer annular face portion increasing said supporting face, and a circumferential groove formed between said face portions, said outer annular face portion of said supporting face also having at least one substantially radial groove communicating said circumferential groove with said suction chamber and performing only supporting function without performing sealing function as well as being lubricated through said grooves; and a pressure spring arranged to bias said supporting face with a sealing edge of said cylinder against said support of said pressure valve member and to bias said piston shoe of said piston against said eccentric in force-transmitting manner, said spring having a predetermined force acting between said annular face portions or said supporting face upon said support of said pressure valve member, said annular face portions of said supporting face having a predetermined dimension increased by the provision of said additional outer annular face portion and selected so that a ratio of said force and said dimension does not exceed substantially 2.5 kg/cm$^2$.

2. A hydrostatic radial piston pump as defined in claim 1, wherein said supporting face of said cylinder has a plurality of such radial grooves communicating said annular groove with said suction chamber.

3. A hydrostatic radial piston pump as defined in claim 1, wherein said outer and inner annular face portions of said supporting face of said cylinder have approximately identical dimensions.

* * * * *